US005275103A

United States Patent [19]

Hahne

[11] Patent Number: 5,275,103

[45] Date of Patent: Jan. 4, 1994

[54] DEVICE FOR INCREASING HEAT TRANSMISSION TO THE COOLING CYLINDERS IN ROTARY-OFFSET MACHINES

[75] Inventor: Ernst A. Hahne, Allschwil, Switzerland

[73] Assignee: Eltex-Elektrostatik GmbH, Weil am Rhein, Fed. Rep. of Germany

[21] Appl. No.: 875,987

[22] Filed: Apr. 29, 1992

[30] Foreign Application Priority Data

Jun. 7, 1991 [DE] Fed. Rep. of Germany ..... 4118807

[51] Int. Cl.[5] ..... B41F 23/04

[52] U.S. Cl. ..... 101/488; 101/457; 226/94

[58] Field of Search ..... 101/480, 488, 487; 226/94

[56] References Cited

U.S. PATENT DOCUMENTS

| | | | |
|---|---|---|---|
| 3,068,528 | 12/1962 | Owens | 226/94 |
| 3,427,686 | 2/1969 | Busby | 226/94 |
| 3,779,682 | 12/1973 | Huskey | 226/94 |
| 3,924,563 | 12/1975 | Kessler | 226/94 |
| 4,046,842 | 9/1977 | Groves et al. | 226/94 |
| 4,462,528 | 7/1984 | Kisler | 226/120 |
| 4,852,820 | 8/1989 | Looser | 226/94 |
| 4,920,881 | 5/1990 | Tafel | 101/488 |
| 5,074,213 | 12/1991 | Kurosawa | 101/487 |

FOREIGN PATENT DOCUMENTS

| | | | |
|---|---|---|---|
| 0166459 | 7/1986 | Japan | 226/94 |

*Primary Examiner*—Edgar S. BUrr
*Assistant Examiner*—John S. Hilten
*Attorney, Agent, or Firm*—Max Fogiel

[57] ABSTRACT

A device for increasing heat transmission to the cooling cylinders in rotary-offset machines in order to cool a web of printed and dried stock. One or more charging electrodes are positioned where the web comes into contact with the cooling cylinders.

3 Claims, 1 Drawing Sheet

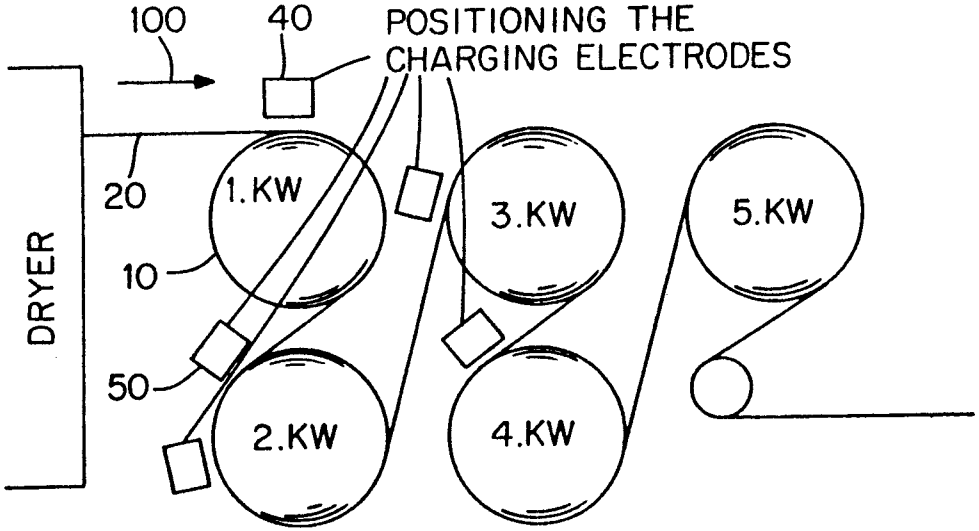
POSITIONING THE
CHARGING ELECTRODES
100
40
20
10
50
1.KW
2.KW
3.KW
4.KW
5.KW
DRYER

DEVICE FOR INCREASING HEAT TRANSMISSION TO THE COOLING CYLINDERS IN ROTARY-OFFSET MACHINES

BACKGROUND OF THE INVENTION

The invention concerns a device for increasing heat transmission to the cooling cylinders in rotary-offset machines.

Stock that has been printed in a rotary-offset machine is advanced through a drier that vaporizes or oxidizes the ink solvent. The ink can be dried with hot air or by gas flames that act directly on the web of stock. Once dry, the web travels over cooling cylinders that restore the ink and stock to normal temperature. Powerful cooling completely solidifies the ink, which will not smear during further processing.

High printing speeds impel the boundary layer of air adhering to the web and to the surface of the cooling cylinder into the area of the cylinder that is wrapped by the web, where it forms a cushion. This cushion of air considerably impedes the transmission of heat, and droplets of oil condense on the cylinder.

When the machine is operating slowly enough (approximately 5 m/sec) to maintain satisfactory contact between the web and the cooling cylinder, the oil can be removed from the web without sacrificing printing quality.

At a critical speed that depends on the overall geometry and on the specific tension on the web, however, the web will lift itself off the cooling cylinder and oil will become suspended in the air in the gap. Oil will accordingly accumulate on the first cooling cylinder, dissolving the dry ink again and smearing the print.

As the speed increases, the coefficient of heat transmission from the printed matter or web to the cooling cylinder will decrease steadily. Any increase in heat resistance will obviously depend on the thickness of the enclosed air gap.

A known device for eliminating re-vaporized oil is called a dynamic boundary-layer doctor. This component is positioned directly behind the drier and eliminates some of the re-vaporized oil between the drier and the first cooling cylinder by blowing air onto it from a circulating system that communicates with a condenser for separating the oil.

This device is very complicated and even so does not ensure high-quality printing because it cannot eliminate enough oil.

In what is called chill jetting, a narrow jet of air is directed at the web where the web comes into contact with the cylinder to force them together tighter.

But this procedure is also unsatisfactory at high printing speeds because it does not prevent oil condensation leading to deposits of ink on the cooling cylinder that powerfully deteriorate the printing quality.

SUMMARY OF THE INVENTION

The object of the present invention is a device for increasing heat transmission to the cooling cylinders in rotary-offset machines that will provide technically simple means of improving print quality at high printing speeds.

This object is attained in accordance with the invention as recited in the major claim.

The charging electrodes generate electrostatic forces that powerfully reduces the air gap. This occurs at a specific voltage that depends on the ambient climatic conditions and on how moist the stock is. Since the web will now rest tight against the cooling cylinder, the cylinder will be able to absorb heat from the web more rapidly. No oil vapor will be present, and the printed matter will not smear.

The process can be optimized with additional charging electrodes at the second and third cooling cylinders. This approach will reduce the air gap even further.

The electrostatic charges improve the transmission of heat to the first cooling cylinder to such an extent that less cylinders will be needed.

One embodiment of the invention will now be specified by way of example with reference to the drawing.

BRIEF DESCRIPTION OF THE DRAWING

A schematic view showing the transport of the web over cooling cylinders and in relation to the charging electrodes, in accordance with the present invention.

DESCRIPTION OF THE PREFERRED EMBODIMENTS

The drawing illustrates a small section through a cooling cylinder 10. A web 20 of stock travels in the direction indicated by arrow 100. An air gap is left between the cylinder and the web.

A charging electrode 40 is positioned where web 20 enters and near the surface of the cooling cylinder. The electrode extends at least over the width of the web and is plate-shaped. The axis of charging electrode 40 preferably parallels that of the cooling cylinder.

Another charging electrode 50 is positioned in the same relation to the second cooling cylinder as charging electrode 40 is to the first charging electrode 40.

Additional electrodes can if necessary be associated with the remaining cooling cylinders.

I claim:

1. An arrangement for increasing heat transmission to cooling cylinders in rotary-offset printing machines, comprising: a plurality of cooling cylinders arranged along a path of motion of a printed and dried web of material; means for feeding said web over surfaces of said cooling cylinders for cooling said web progressively as said web travels over the surfaces of said cooling cylinders in predetermined sequence; means for eliminating formation of an air cushion between said web and the surface of said first one of said cylinders contacted by said web to avoid subsequent condensation of printed colors comprising a plate-shaped charging electrode adjacent a surface of a first one of said cylinders in said sequence at a location where said web first comes into contact with said cylinders to commence cooling said web, elimination of said air cushion eliminating a layer resistant to heat transfer so that heat flow from said web to said first one of said cooling cylinders is increased and said web is cooled within a relatively shorter period of time, means for energizing said charging electrode to produce a predetermined potential between the web and the cylinder dependent on ambient conditions and moisture in said web to generate electrostatic forces that reduce any air gap between said web and said first one of said cooling cylinders to bring said web tightly against said first one of said cooling cylinders and increase absorption of heat from said web and avoid presence of oil vapor to prevent smearing of printed matter on said web, said web contacting said cooling cylinders after having been printed and dried.

2. An arrangement as defined in claim 1, wherein said charging electrode is a first electrode; and a second plate-shaped charging electrode adjacent a second one of said cooling cylinders in said sequence in the path of travel of said web for eliminating formation of an air cushion between said web and said second one of said cooling cylinders.

3. An arrangement as defined in claim 1, wherein said means for eliminating comprises an additional plate-shaped charging electrode adjacent each of said cooling cylinders at surfaces where said web contacts said cylinders in traveling thereover in said sequence.

* * * * *